United States Patent [19]

Schadow et al.

[11] 4,091,731

[45] May 30, 1978

[54] FUEL INJECTION WITH FLAMEHOLDING

[75] Inventors: Klaus C. Schadow; Don J. Chieze, both of Ridgecrest, Calif.

[73] Assignee: The United States of America as represented by the Secretary of the Navy, Washington, D.C.

[21] Appl. No.: 702,641

[22] Filed: Jul. 6, 1976

[51] Int. Cl.[2] ..... F42B 5/10

[52] U.S. Cl. ..... 102/49.1; 60/251; 60/270 S

[58] Field of Search ..... 102/49.1; 60/251, 261, 60/39.74 R, 39.72 R, 270 R, 270 S

[56] References Cited

U.S. PATENT DOCUMENTS

| | | | |
|---|---|---|---|
| 2,592,110 | 4/1952 | Berggren et al. | 60/39.72 R |
| 2,828,603 | 4/1958 | Laucher | 60/39.72 R |
| 2,914,912 | 12/1959 | Woll | 60/39.74 R |
| 3,273,334 | 9/1966 | Tanczos et al. | 60/270 R |
| 3,486,339 | 12/1969 | Owens et al. | 60/261 |
| 3,807,169 | 4/1974 | Bradford | 60/261 |
| 3,864,907 | 11/1975 | Curran | 60/261 |

*Primary Examiner*—Samuel Feinberg

*Attorney, Agent, or Firm*—R. S. Sciascia; Roy Miller; K. G. Pritchard

[57] ABSTRACT

A method and apparatus for improving combustion efficiency in external burning assisted projectiles by providing a stepped configuration of the projectile body and placing the injector ports in the recirculation zone created behind said step near the base of the projectile.

6 Claims, 3 Drawing Figures

FUEL INJECTION WITH FLAMEHOLDING

CROSS REFERENCE TO RELATED APPLICATION

The device disclosed in this application is similar in some aspects to that disclosed in assignee's copending application Ser. No. 702,387, filed of even date and identified further as Navy Case No. 57766.

BACKGROUND OF THE INVENTION

Devices for the manipulation of base pressure on a bluffbase body by combustion in some region around the base have been investigated and a paper entitled "Theoretical Consideration of Combustion Effects on Base Pressure in Supersonic Flight" by Warren C. Strahle may be found in the publication by Combustion Institute, Pittsburgh, Pennsylvania entitled "Twelfth Symposium [International] on Combustion," (1969) pp. 1163–1173.

Prior investigations by Strahle indicate that a certain amount of thrust is attainable in the flight of a solid propellant assisted projectile by achieving combustion of a fuel-rich exhaust in some region around the base of the projectile.

SUMMARY OF THE INVENTION

The rocket assisted projectiles according to the present inventon include novel means for increasing base pressure on a bluff-base portion of the projectile by forming a step in the body of the projectile near the bluff-base portion forward of the injector ports.

DESCRIPTION OF THE PREFERRED EMBODIMENT

Figure 1:
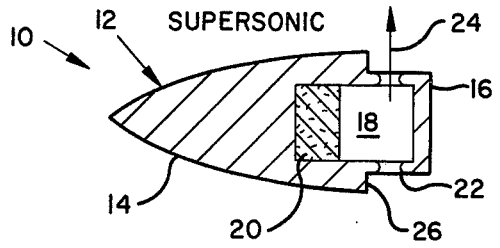
FIG. 1 is a side elevation partly in section of a rocket assisted projectile according to the present invention.

The rocket assisted projectile generally indicated by the numeral 10 in FIG. 1 comprises a body 12 having an ogival nose section 14 and a bluff-base 16. Contained within the body 12 is a combustion chamber 18 which is provided for burning of a solid propellant 20.

The products of combustion of the solid propellant 20 emanate from chamber 18 through port or ports 22 through which the products of combustion are injected as shown by arrow 24 into the airstream flowing past the projectile while in flight.

According to the present invention, the body 12 of the projectile increases fairly uniformly from the point of the nose 14 to the base 16 with the exception that a step 26 is formed in the body 12 just forward of the area into which the gases 24 are injected into the airstream. This configuration causes a recirculation zone just behind step 26 and when the gases 24 are injected into this region, combustion efficiency is noticeably increased.

Significant improvement of the ignition and combustion processes for external burning has been thus achieved by injecting the fuel-rich exhaust of the solid propellant motor into the recirculation zone behind the downstream facing step. In one example, with subsonic exhaust and the step configuration, it was possible to greatly improve the combustion at a combustion chamber temperature of 1600° K, which is well below 2200° K, the temperature of 80% AP/20% HTPB propellant used as a base line.

AP = Ammonium Perchlorate

HTPB = Hydroxyterminated Polybutadiene

Without the step, the combustion extinguished a short distance downstream. On the other hand, with a quarter inch step, for example, intense combustion continued with increasing mixing length.

With supersonic primary exhaust velocity and the quarter inch step, ignition and intense combustion of the fuel-rich reaction products were possible at 2200° K primary chamber temperature. Under the same circumstances, without the step, no ignition occurred in the airstream.

Figure 2:
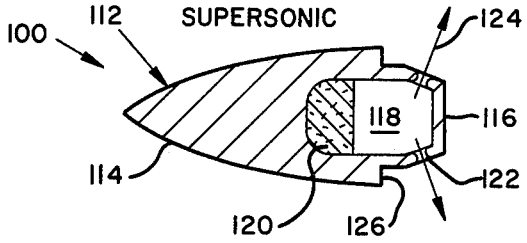
FIG. 2 is a view similar to FIG. 1 of a second modification of a rocket assisted projectile according to the invention.

The FIG. 2 device generally indicated at 100 is similar in all aspects to the device of FIG. 1 except that the products of combustion 124 are injected into the airstream at an angle achieved by the angular positioning of the port or ports 122.

Figure 3:
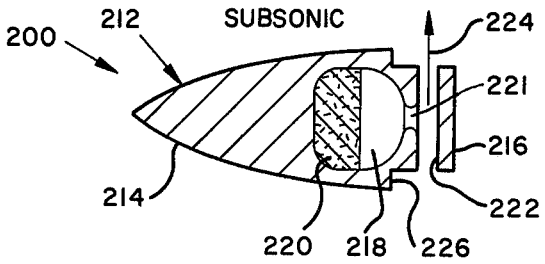
FIG. 3 is a view similar to FIG. 1 of still a third embodiment of the invention.

In the projectile illustrated generally at 200 in FIG. 3, chamber 118 does not communicate directly through the injection port means 224 because of a primary nozzle 221 placed between the chamber 118 and the injection means 224. In this configuration, the gases emanate from port means 224 at subsonic speed.

Although three specific embodiments of the invention have been illustrated and described above, it is contemplated that other arrangements of ports and nozzles may be resorted to in injecting the products of combustion into the air stream behind the step depending upon fuel composition and other factors.

What is claimed is:

1. A rocket assisted projectile comprising:

a projectile body including an ogival nose portion and a bluff base;

a solid propellant motor in said body including a primary combustion chamber;

said combustion chamber communicating externally of said body through injector port means having at least one exit around the periphery of said body near said bluff base;

said body having a substantially uniformly increasing circular cross section from the forward end of said nose portion to a point just forward of said injector port means;

said body at said point being reduced sharply to present a step at a predetermined distance forward of said injector port means so that a recirculation zone is created behind said step and, when said motor is activated, the products of combustion from said chamber are injected into said recirculation zone.

2. A rocket assisted projectile according to claim 1 wherein said injector port means comprises a plurality of openings spaced around said body.

3. A rocket assisted projectile according to claim 2 wherein said injector point means is so arranged that the products of combustion are injected into the recirculation zone at an angle of about 45° to the longitudinal axis of the projectile body.

4. A rocket assisted projectile according to claim 2 further including primary nozzle means between said combustion chamber and said injector port means;

said primary nozzle means in combination with said injector port means being effective to slow said products of combustion to subsonic speed before being injected into the recirculation zone.

5. A rocket assisted projectile accrding to claim 1 wherein said injector port means is so arranged that the products of combustion are injected into the recirculation zone at an angle of about 45° to the longitudinal axis of the projectile body.

6. A rocket assisted projectile according to claim 1 further including a primary nozzle between said combustion chamber and said injector means;

said primary nozzle in combination with said injector port means being effective to slow said products of combustion to subsonic speed before being injected into the recirculation zone.

* * * * *